US005461954A

United States Patent [19]

Boriani et al.

[11] Patent Number: 5,461,954

[45] Date of Patent: Oct. 31, 1995

[54] METHOD AND DEVICE FOR FEEDING PORTIONS OF WRAPPING MATERIAL TO A PACKING LINE

[75] Inventors: Silvano Boriani; Alessandro Minarelli, both of Bologna, Italy

[73] Assignee: G.D Societa' Per Azioni, Bologna, Italy

[21] Appl. No.: 254,130

[22] Filed: Jun. 6, 1994

[30] Foreign Application Priority Data

Jun. 18, 1993 [IT] Italy ..... BO93A0276

[51] Int. Cl.[6] ..... B65B 41/00; B65B 11/00; B26D 3/08; B26D 3/12

[52] U.S. Cl. ..... 83/49; 83/349; 53/389.3; 53/389.4; 53/389.5; 53/466

[58] Field of Search ..... 53/380.3, 389.4, 53/389.5, 466, 234, 228, 461; 83/49, 349, 678

[56] References Cited

U.S. PATENT DOCUMENTS

| | | | |
|---|---|---|---|
| 3,277,630 | 10/1966 | Youngman et al. | 53/389.3 |
| 3,355,166 | 11/1967 | Plumb | 53/389.5 |
| 3,367,221 | 2/1968 | Schermund | 53/389.3 |
| 3,982,375 | 9/1976 | Focke | 53/389.3 |
| 4,385,479 | 5/1983 | Focke | 53/389.3 |
| 4,388,794 | 6/1983 | Focke et al. | 53/389.3 |
| 4,495,746 | 1/1985 | Focke et al. | 53/389.5 |
| 5,327,702 | 7/1994 | Taylor | 53/389.3 |

FOREIGN PATENT DOCUMENTS

| | | | |
|---|---|---|---|
| 1550136 | 6/1976 | United Kingdom | 53/389.3 |

*Primary Examiner*—John Sipos
*Assistant Examiner*—Rodney A. Butler
*Attorney, Agent, or Firm*—Klauber & Jackson

[57] ABSTRACT

A method of feeding portions of wrapping material, cut off a continuous strip, to a packing line, which method, for feeding each portion, includes stages consisting in making in the strip at least a first partial transverse cut by means of a first fixed blade cooperating with a movable blade; and in making in the strip at least a second partial transverse cut, aligned longitudinally with the first partial transverse cut and completing detachment of the portion, by means of a second fixed blade cooperating with the movable blade; the strip, in the course of making the second partial transverse cut, being drawn by feed elements not involving the strip portion in which the second partial transverse cut is to be made.

7 Claims, 2 Drawing Sheets

METHOD AND DEVICE FOR FEEDING PORTIONS OF WRAPPING MATERIAL TO A PACKING LINE

BACKGROUND OF THE INVENTION

The present invention relates to a method of feeding portions of wrapping material to a packing line.

In particular, the present invention relates to a method of dividing a continuous strip of wrapping material into single portions or sheets, and successively feeding the portions to a packing line consisting, for example, of an overwrapping line for packets of cigarettes or boxes or cartons containing a number of packets of cigarettes.

According to British Patent n. 1,550,136, a continuous strip is fed to a packing line using two separate supply lines arranged in series. The first feed unit upstream comprises two intermittent counter-rotating rollers substantially tangent to each other, and respective peripheral portions of which run along the strip; while the second feed unit comprises two continuous intermittently operated suction belts for retaining and drawing along respective lateral edges of the strip.

According to the above British patent, the portions of wrapping material are detached from the continuous strip using two separate cutting devices arranged in series along said path portion. More specifically, for detaching each sheet from the strip, the first cutting device makes two longitudinally aligned transverse lateral cuts in respective lateral edges of the strip between the two feed units; while the second cutting device, operating on the laterally cut strip portion under control of the second feed unit, makes a central cut in the strip to join the two lateral cuts and so detach the sheet. While still under control of the second feed unit, each sheet is then intercepted at a transfer station by the product for wrapping, by which it is pushed towards the packing line.

Cutting the sheets off the continuous strip in two stages is extremely advantageous in that it permits both the strip and the sheets to be fed exclusively by traction to the transfer station, thus eliminating any possibility of jamming, were the strip or sheets at any time to be pushed downstream as they travel towards the transfer station.

Though fairly satisfactory, the above device is particularly complex and expensive, due to featuring two cutting devices.

SUMMARY OF THE INVENTION

It is an object of the present invention to provide a highly reliable, relatively straightforward, low-cost method of feeding portions of wrapping material to a packing line.

According to the present invention, there is provided a method of feeding portions of wrapping material to a packing line, whereby said portions are cut successively off a continuous strip; characterized in that, for feeding each portion, the present invention comprises making at least a first partial transverse cut in said strip by means of first fixed cutting means cooperating with movable cutting means; and making in said strip at least a second partial transverse cut, aligned longitudinally with said first partial transverse cut and completing detachment of said portion, by means of second fixed cutting means cooperating with said movable cutting means; said strip, in the course of making said second partial transverse cut, being drawn by feed means not involving the strip portion in which the second partial transverse cut is to be made.

The present invention also relates to a device for feeding portions of wrapping material to a packing line.

According to the present invention, there is provided a device for feeding portions of wrapping material to a packing line, whereby said portions are cut successively off a continuous strip; characterized in that the present invention comprises first fixed cutting means and movable cutting means cooperating with each other for making, in the course of detaching each portion, at least a first partial transverse cut in said strip; and second fixed cutting means cooperating with said movable cutting means, for making in said strip at least a second partial transverse cut aligned longitudinally with said first partial transverse cut and completing detachment of said portion; feed means being provided for drawing said strip in the course of making said second partial transverse cut, and which do not involve the strip portion in which the second partial transverse cut is to be made.

Said device preferably comprises strip conveying means located upstream from said feed means and supporting said movable cutting means.

According to a preferred embodiment of the present invention, said strip conveying means comprises a roller rotating about its axis, wherein at least part of the cylindrical peripheral surface of the roller is permeable to air and connectable to a suction source.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figure 1:
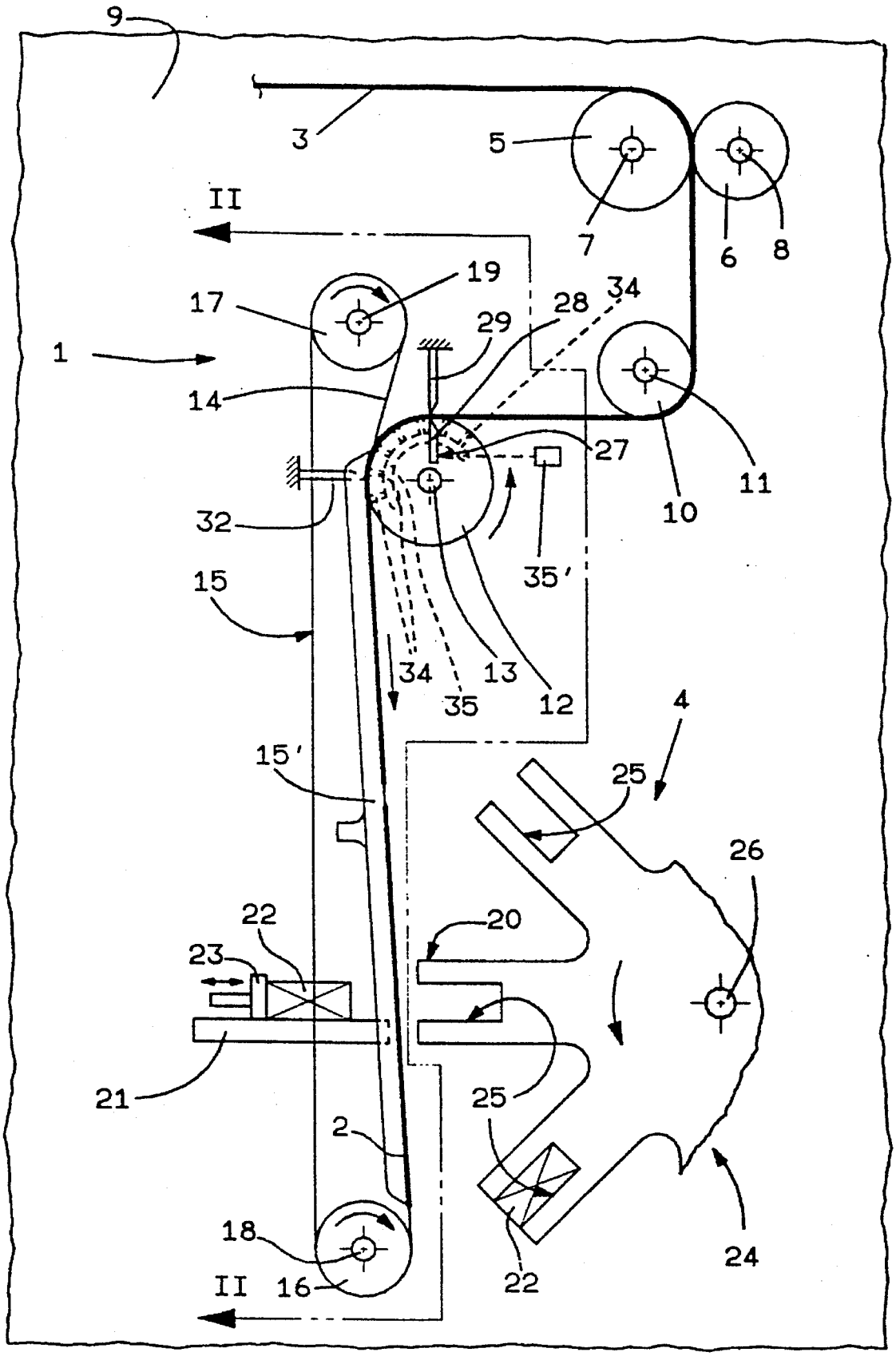
FIG. 1 shows a schematic front view of a device for feeding portions of wrapping material, in accordance with the present invention.

Number 1 in FIG. 1 indicates a device for feeding portions or sheets 2 of wrapping material, cut off a continuous strip 3 wound off a reel (not shown), to a packing line indicated as a whole by 4.

Device 1 comprises two rollers 5 and 6 rotating about respective horizontal parallel axes, and which, like all the other rollers referred to hereinafter, present a width at least equal to that of strip 3. Rollers 5 and 6 are fitted coaxially and idly to respective shafts 7 and 8 fitted to a vertical wall 9 forming part of the bed of a packing machine (not shown). Strip 3 runs between rollers 5 and 6, and then about an idle guide roller 10 supported on a shaft 11 fitted perpendicularly to wall 9, beneath rollers 5 and 6.

Downstream from roller 10, strip 3 runs about a conveyor element consisting of a roller 12 fitted to a shaft 13 in turn fitted perpendicularly to wall 9 and rotated intermittently anticlockwise by drive means (not shown).

At a portion to the left in FIG. 1, the two lateral edges of the cylindrical surface of roller 12 run along respective substantially vertical branches 14 of two known side by side suction belts 15 looped about a bottom and top roller 16 and 17 (see also FIG. 2) fitted to respective horizontal shafts 18 and 19 rotated intermittently clockwise by drive means (not shown).

Belts 15 constitute the feed means described and illustrated in British Patent n. 1,550,136 referred to previously, and are made of material permeable to air. As shown schematically in FIG. 1, inside the loop defined by each belt 15, a chamber 15' communicating with a suction source (not shown) extends along the branch of each belt 15 extending substantially between rollers 12 and 16.

Figure 2:
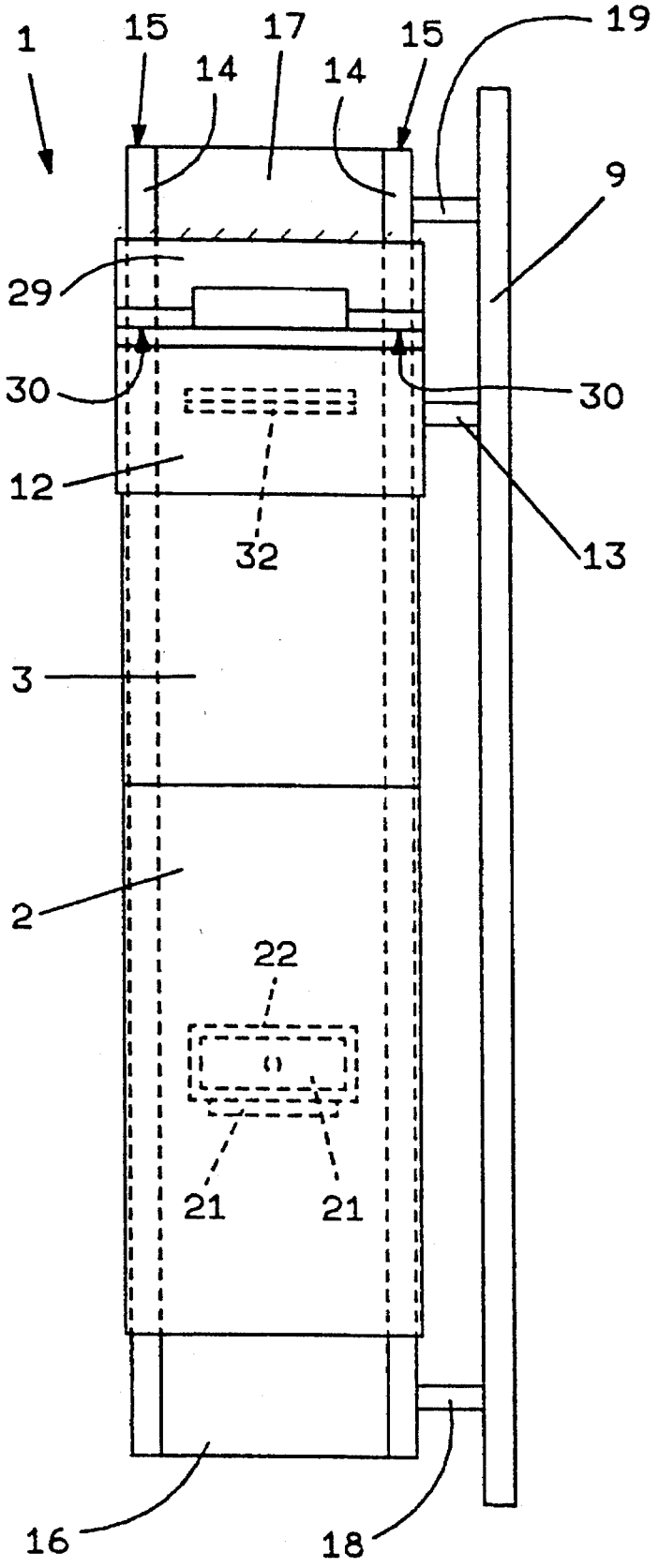
FIG. 2 shows a schematic view along line II—II in FIG. 1 of the device according to the present invention.

Between branches 14 of belts 15, beneath roller 12 and at a transfer station 20, there is provided a horizontal supporting surface 21 fitted rigidly to wall 9 and onto which are fed successively in known manner (not shown), and in a direction perpendicular to the FIG. 2 plane, products consisting, for example of packets of cigarettes 22. A push element 23, moved back and forth in a horizontal direction perpendicular to the axis of roller 12 by actuating means (not shown), provides for pushing packets 22 successively between belts 15 to packing line 4. Packing line 4 comprises a wrapping wheel 24 presenting radial seats 25, and supported on and rotated intermittently anticlockwise by a shaft 26 extending perpendicularly from wall 9. As will be made clear later on, the packets 22 fed to packing line 4 by push element 23 are fed into respective seats 25 on wrapping wheel 24.

Inside a radial cavity 27 on roller 12, there is fitted a blade 28 extending parallel to the axis of roller 12, and the cutting edge of which projects slightly (e.g. by three-tenths of a millimeter) from the cylindrical surface of roller 12. Hereinafter, blade 28 will also be referred to as a "movable cutting means".

Figure 3:
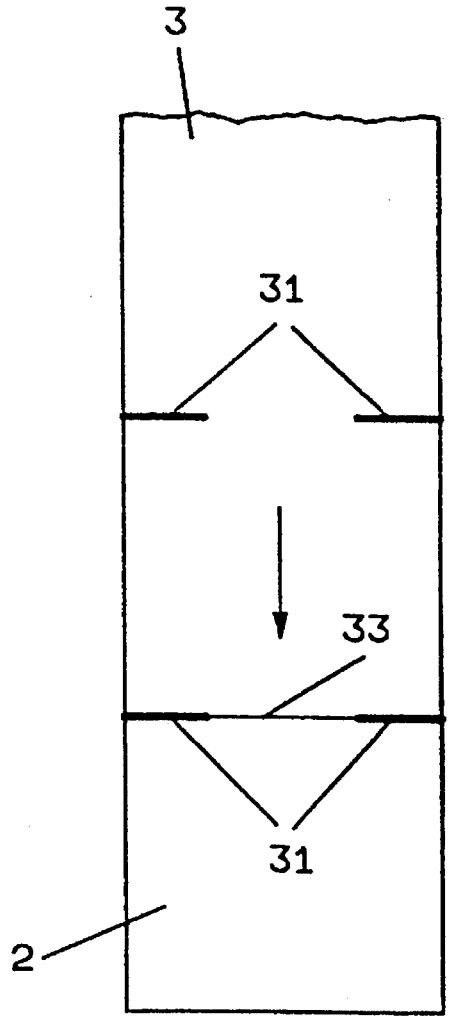
FIG. 3 shows a portion of a strip of wrapping material as operated on by the device in FIGS. 1 and 2.

Upstream, in the traveling direction of strip 3, from the point of contact between roller 12 and belts 15, wall 9 supports fixed cutting means consisting of a blade 29 extending in the vertical plane containing the axis of roller 12. Blade 29 is substantially C-shaped (FIG. 2), and presents two downward-facing lateral cutting edges 30 cooperating, as roller 12 rotates, with respective lateral portions of the cutting edge of blade 28, so as to cyclically make in strip 3 two longitudinally-aligned transverse lateral cuts 31 (FIG. 3) wider than belts 15.

Substantially at the point of substantial tangency between roller 12 and belts 15, with reference to the traveling direction of strip 3, wall 9 also supports fixed cutting means consisting of a blade 32 extending in the horizontal plane containing the axis of roller 12. Blade 32 is located centrally in relation to the axial dimension of roller 12, and is narrower than the distance between the two belts 15. As roller 12 rotates, blade 32 cooperates with blade 28 to cyclically make in strip 3 a central transverse cut 33 (FIG. 3) of a width equal to or no smaller than the distance between two longitudinally-aligned cuts 31.

Two cylindrical surface portions of roller 12, respectively up- and downstream from blade 28 in the rotation direction of roller 12, present in known manner (FIG. 1) a number of radial holes 34 communicating in known manner with a fixed distribution chamber 35 located close to the top portion of roller 12 and connected to a suction source shown schematically by block 35'. Consequently, and as will be made clear later on, for each turn of roller 12, the action of blades 28, 29 and 32 on strip 3 and connection of holes 34 to suction source 35' are so combined as to retain strip 3 by suction firmly contacting the portion of roller 12 substantially extending between the points in which blade 28 contacts blades 29 and 32.

In actual use, strip 3 is drawn by the combined action of rollers 5 and 6 and belts 15 to transfer station 20.

For each turn of roller 12, blade 28 cooperates with blade 29 to make in strip 3 two longitudinally-aligned lateral cuts 31, which are then joined by blades 28 and 32 making a central cut 33, so as to detach a sheet 2 from strip 3.

Each sheet 2 is then fed by belts 15 to transfer station 20 where push element 23 inserts sheet 2, together with packet 22, into a seat 25 on wrapping wheel 24.

In the course of the above cutting operations, the portions of strip 3 close to cuts 31 and 33 are drawn along regularly at all times and maintained in the correct position by suction holes 34; and the fact that each sheet 2 is only detached by blades 28 and 32 when it is firmly retained and drawn along by belts 15, and when the portion of strip 3 upstream from sheet 2 is retained and drawn along by suction by roller 12, provides, as already stated, for feeding sheets 2 and strip 3 exclusively by means of traction, thus ensuring troublefree supply with no possibility of jamming.

By virtue of comprising only one movable blade 28 cooperating with two fixed blades 29 and 32, device 1 as described is not only extremely compact but also more straightforward and cheaper to produce as compared with the known devices described.

Moreover, according to a variation (not shown) of device 1, strip 3 and sheets 2 may be fed to packing line 4 by means of a single suction belt 15 acting on only one lateral portion of strip 3 and sheets 2. In which case, of course, a blade (not shown), supported in the same way as blade 29 but having only one cutting edge, would make a transverse cut, together with rotary blade 28, in the portion of strip 3 later to be retained by said suction belt 15; and blade 32, together with rotary blade 28, would complete the cut to detach sheets 2 in the same way as already described.

Finally, according to a further variation (not shown) of device 1, blades 29 and 32 may present a number of cutting edges arranged "comb fashion" and offset on one blade in relation to the other. In which case, blade 29, together with rotary blade 28, would make in strip 3 a number of transverse cuts, one for each cutting edge, which would then be joined by blade 32 cooperating with rotary blade 28.

We claim:

1. A method for feeding portions (2) of wrapping material to a packing line wherein said portions (2) are cut successively off a continuous strip (3) of wrapping material, said method, for each said portion (2), comprising the steps of:

providing said strip (3) to a strip conveying means (12), said strip conveying means (12) supporting a movable cutting means (28);

making at least one first partial transverse cut (31) in said strip (3) by means of a first fixed cutting means (29) cooperating with said movable cutting means (28), said at least one first partial transverse cut (31) initiating detachment of said portion (2);

making at least one second partial transverse cut (33) in said strip (3) by means of a second fixed cutting means (32) cooperating with said movable cutting means (28), said at least one second partial transverse cut (33) being aligned longitudinally with said at least one first partial transverse cut (31), said at least one second partial transverse cut (33) completing detachment of said portion (2); and drawing said strip (3) from said strip conveying means (12), in the course of making said at least one second partial transverse cut (33), by feed means (15) not involving the strip portion in which said at least one second partial transverse cut (33) is to be made.

2. The method as defined in claim 1, further comprising retaining said strip (3) on a portion of said strip conveying means (12) substantially extending between where said movable cutting means (28) cooperates with said first fixed cutting means (29) and said movable cutting means (28) cooperates with said second fixed cutting means (32).

3. A device for feeding portions (2) of wrapping material to a packing line wherein said portions (2) are cut successively off a continuous strip (3) of wrapping material, said device comprising:

movable cutting means (28);

first fixed cutting means (29) cooperating with said movable cutting means (28) for making at least one first partial transverse cut (31) in said strip (3), said at least one first partial transverse cut (31) initiating detachment of said portions (2);

second fixed cutting means (32) cooperating with said movable cutting means (28) for making at least one second partial transverse cut (33) in said strip (3), said at least one second partial transverse cut (33) being aligned longitudinally with said at least one first partial transverse cut (31), said at least one second partial transverse cut (33) completing detachment of said portions (2); and feed means (15) for drawing said strip (3) in the course of making said at least one second partial transverse cut (33), said feed means (15) not involving the strip portion in which said at least one second partial transverse cut (33) is to be made.

4. The device as defined in claim 3, further comprising strip conveying means (12) located upstream from said feed means (15), said strip conveying means (12) supporting said movable cutting means (28).

5. The device as defined in claim 4, wherein said strip conveying means (12) comprises a rotatable roller (12) having a cylindrical peripheral surface, and wherein at least a portion of said cylindrical peripheral surface is permeable to air and connectable to a suction source (35') for retaining said strip (3) on said portion.

6. A device for feeding portions (2) of wrapping material to a packing line wherein said portions (2) are cut successively off a continuous strip (3) of wrapping material, said device comprising:

strip conveying means (12) for conveying said strip (3), said strip conveying means (12) supporting a movable cutting means (28);

first fixed cutting means (29) cooperating with said movable cutting means (28) for making at least one first partial transverse cut (31) in said strip (3), said at least one first partial transverse cut (31) initiating detachment of said portions (2);

second fixed cutting means (32) cooperating with said movable cutting means (28) for making at least one second partial transverse cut (33) in said strip (3), said at least one second partial transverse cut (33) being aligned longitudinally with said at least one first partial transverse cut (31), said at least one second partial transverse cut (33) completing detachment of said portions (2); and feed means (15), located downstream from said strip conveying means (12), for drawing said strip (3) from said strip conveying means (12) in the course of making said at least one second partial transverse cut (33), said feed means (15) not involving the strip portion in which said at least one second partial transverse cut (33) is to be made.

7. The device as defined in claim 6, wherein said strip conveying means (12) comprises a rotatable roller (12) having a cylindrical peripheral surface, and wherein at least a portion of said cylindrical peripheral surface is permeable to air and connectable to a suction source (35') for retaining said strip (3) on said portion.

* * * * *